US008476999B1

(12) United States Patent
Patterson

(10) Patent No.: US 8,476,999 B1
(45) **Date of Patent: *Jul. 2, 2013**

(54) MAGNETICALLY LOADED ELECTROMECHANICAL SWITCHES

(76) Inventor: Paul D. Patterson, Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/533,768

(22) Filed: Jun. 26, 2012

Related U.S. Application Data

(63) Continuation-in-part of application No. 12/860,008, filed on Aug. 20, 2010, now Pat. No. 8,217,741.

(60) Provisional application No. 61/237,114, filed on Aug. 26, 2009.

(51) Int. Cl.
*H01H 9/00* (2006.01)

(52) U.S. Cl.
USPC ..... 335/179; 335/205

(58) Field of Classification Search
USPC ..... 335/179
See application file for complete search history.

(56) References Cited

U.S. PATENT DOCUMENTS 2,483,815 A * 10/1949 Easton ..... 336/90
3,643,186 A * 2/1972 Fischer ..... 377/85
4,409,576 A * 10/1983 Petersen ..... 335/170
4,625,194 A 11/1986 Held
5,003,275 A * 3/1991 Duimstra ..... 335/154
5,455,550 A * 10/1995 von Alten et al. ..... 335/78
5,929,731 A * 7/1999 Jackson, Jr. ..... 335/207
7,388,461 B2 6/2008 Ryuen et al.

OTHER PUBLICATIONS

Office Action dated Jan. 5, 2012 as in related U.S. Appl. No. 12/860,008.
Office Action dated Feb. 15, 2012 as in related U.S. Appl. No. 12/860,008.
Notice of Allowance dated May 29, 2012 as in related U.S. Appl. No. 12/860,008.

* cited by examiner

*Primary Examiner* — Elvin G Enad
*Assistant Examiner* — Lisa Homza
(74) *Attorney, Agent, or Firm* — Maschoff Brennan

(57) ABSTRACT

A switching device can include a housing with a core rotatably or slidably located therein. The housing and core can have magnetic poles aligned in a natural position at a natural magnetic state. The device can include an armature with a coil that provides armature magnetic poles. The armature magnetic poles are not aligned with the housing magnetic poles. As such, energizing the armature can cause the core to transition from the natural position at the natural magnetic state to an energized position in an energized magnetic state. The core magnetic poles are aligned with the armature magnetic poles when energized. A method can be used that transitions the core when the coil is energized. The core can include a mirror to reflect a beam of light, which can scan the beam of light when the core, and thereby the mirror, is transitioned between natural and energized positions.

35 Claims, 12 Drawing Sheets

3- Way Example (Energized)

MAGNETICALLY LOADED ELECTROMECHANICAL SWITCHES

CROSS-REFERENCE TO RELATED APPLICATIONS

This application is a continuation-in-part of U.S. patent application Ser. No. 12/860,008, filed Aug. 20, 2010 and entitled "MAGNETICALLY LOADED ELECTROMECHANICAL SWITCHES," which claims the benefit of U.S. Provisional Application Ser. No. 61/237,114 filed Aug. 26, 2009 and entitled "MAGNETICALLY LOADED ELECTROMECHANICAL SWITCHES," which applications are incorporated by reference in their entirety.

BACKGROUND OF THE INVENTION

1. The Field of the Invention

Embodiments of the invention relate generally to electromechanical switches and methods of operation and use. More particularly, embodiments of the invention relate to devices capable of controlling and methods that control fluidic elements, pneumatic elements, electrical elements, mirror elements, and optical elements with the switching devices by operation of electromechanical switches.

2. The Relevant Technology

Electronically controlled switches utilize some form of electromagnetic design to generate a change in state for a specific application. These designs commonly include a coil for electronic control, a spring to assist in either closing or opening a point of control, and various designs for the point of control. The point of control for switches in electrical applications commonly includes contacts, while a port hole with some form of plugging mechanism is the point of control for valves and a lens assembly is the point of control for optical switches.

The operation of conventional switches often involves the use of a direct solenoid coil around a core which opens or closes the valve as energy is added or removed from the coil. Some MEMs (Micro-Electro-Mechanical System) designs utilize a cavity squeezing effect, whereby applying energy to a piezo material results in the closure of a cavity or diaphragm.

Currently, springs and hinge mechanism designs often assist in the operation of switches used in valve applications. Some switches have a port hole which is sealed by placing a compliant material over the port hole. Unfortunately, these springs and hinge mechanisms place additional load demands upon the structure. To overcome these demands of the springs and hinge mechanisms, higher magnetic forces are required to operate the switch.

In addition, the switches are often subject to wear and tear. Many valve seats, for example, have a conically shaped needle such that insertion into a conical shaped seat will result in a seal. In most of these designs, any misalignment occurring by virtue of inherent manufacturing tolerances must be compensated for by using relatively stronger springs to forcibly urge the valve design into a fully seated condition. Misalignment can also cause leaking at the valve seat or binding of the mechanical structure.

Each of these conditions place additional demands upon the electromagnet and increase manufacturing costs. Additionally, valve materials used for sealing are under load conditions which increase wear with increased operation. It is desirable, from a cost standpoint, to limit the use of materials in the switches. More specifically, the conductors utilized in switches are generally of a highly conductive material, such as copper or aluminum, which tend to be expensive. It would be advantageous to reduce the materials used (at least in terms of size and/or quantity), power, and cost while maintaining or increasing performance of switches including electromechanical switches.

BRIEF DESCRIPTION OF THE DRAWINGS

To further clarify at least some of the advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Embodiments of the invention relate to switches including electromechanical switches that are compact, reliable, fast operating, capable of being inexpensively manufactured and/or exhibit long operational lifetimes. From a cost, power and size standpoint, embodiments of the invention reduce or minimize the structural demands upon the switch, compared at least to conventional switches. Reducing the load demands in an electromagnetic switch, for example, can aid in minimizing the number of ampere-turns required to operate an electromagnet in the switch. Advantageously, the amount of material required for the switch can also be reduced. Further, embodiments of the invention relate to a switch requiring very low power to operate and having a reduced number of components.

The switches or switching devices disclosed herein, including electromechanical switches, can be used at least in fluidic, electrical, pneumatic, mirror, and/or optical applications. Generally, an electromechanical switch is formed from a magnetically loaded material placed into a ring and plug configuration. A coil is then attached to provide a magnetic field to operate the switching device.

Figure 1:
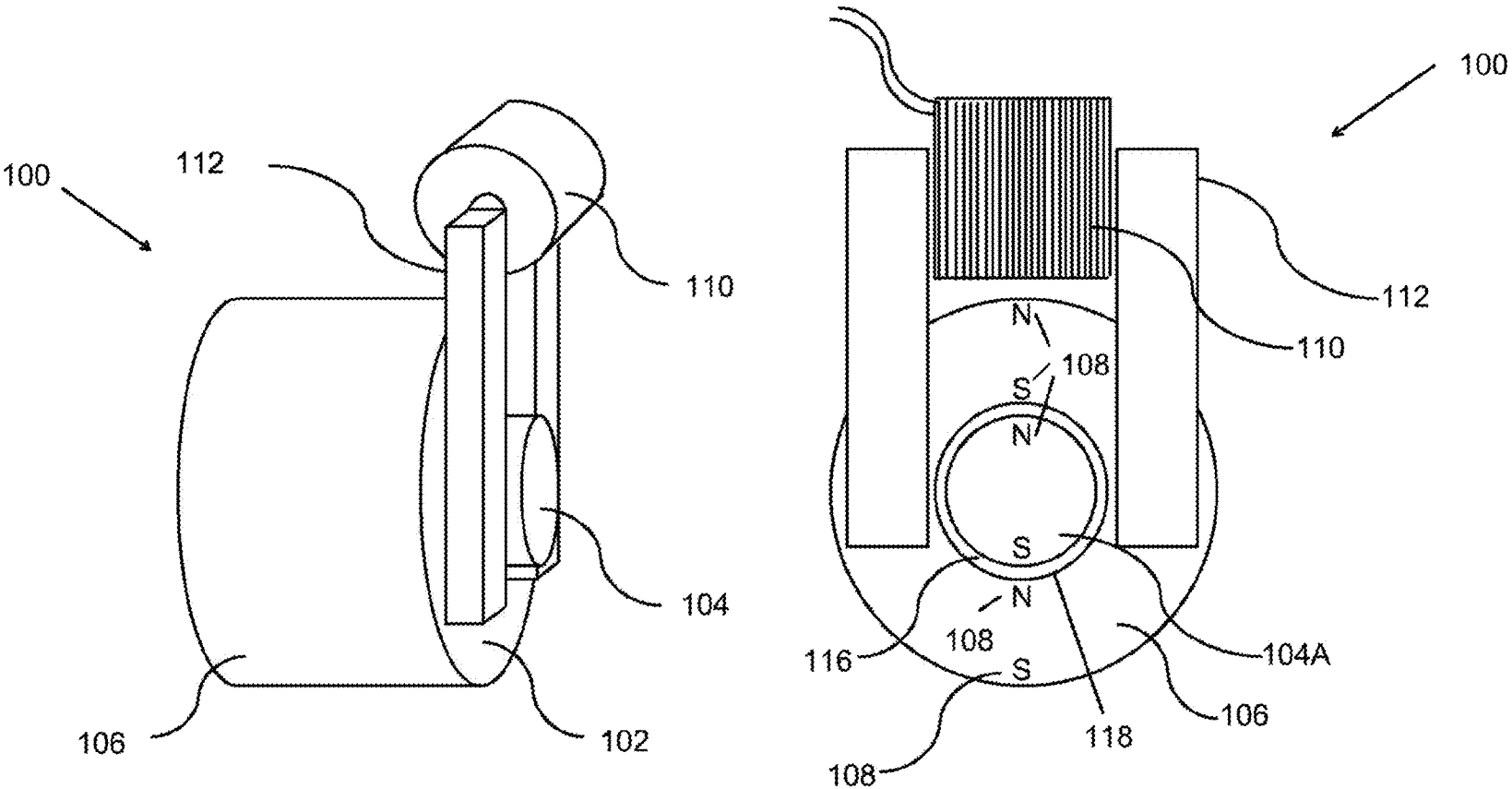
FIG. 1 illustrates a perspective view and a side view of one embodiment of a switch in a natural or non-energized state.

FIG. 1 illustrates one example of a switching device 100 including a perspective view and a side view of the switching device. The switching device includes a body 102 that includes a core 104 and a housing 106. In one example, materials for both the core 104 and the housing 106 include a magnetic material or a material which contains material that can be magnetized, such as injection moldable plastic containing magnetic material. Alnico, neodymium, and samarium cobalt are examples of materials. Injected molding polymers can often be filled to a percentage based on desired material properties.

The housing 106 has an exterior surface or perimeter whose shape can vary. For example, a shape of the exterior surface can be varied according to the use of the switching device 100. The exterior surface (and other features) may be shaped to fit in a particular location of a device or product.

The housing 106 typically includes a cavity 118 that is shaped to receive the core 104. Typically, the cavity 118 has a circular cross section and the core 104 has a circular cross section. The cross section of the core 104 is typically less than the cross section of the cavity 118, thus allowing the core 104 to fit within the cavity 118.

Figure 8:
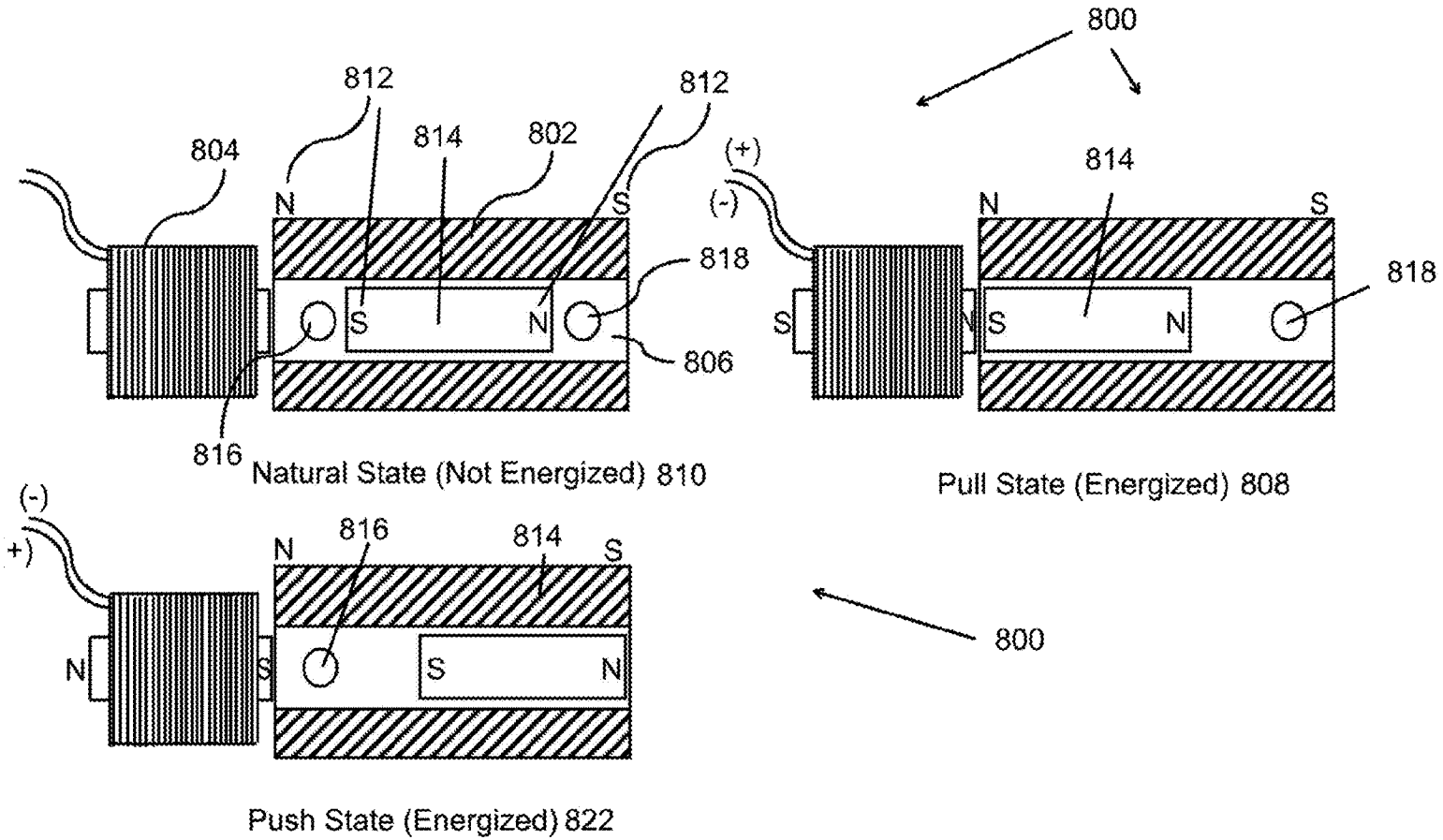
FIG. 8 illustrates an example of a switch that uses at least lateral translational switching action.

Alternatively, the relationship between the housing 106 and the core 104 can take other configurations. In one example, the housing 106 may be ring shaped with a cavity 118 that may be occupied by the core 104. In this example, the core 104 may be viewed as a plug that substantially fills the hole or cavity 118 of the housing 106. As illustrated in FIG. 8, however, the core may not completely fill the cavity but may be allowed to translate laterally within the cavity. More specifically, a length of the core 104 relative to a length of the cavity 118 can vary. As discussed in more detail herein, the differences in length can be used to achieve one or more different states of the switching device 100.

However, the cross sectional area of the housing 106 at the cavity 118 is substantially filled by the core 104—thus the core 104 can be viewed as a plug in this sense. As discussed in more detail herein, the core 104 can be moved laterally within the cavity 118. The core 104 may have a length that is less than a length of the cavity, more than the length of the cavity or the same as the length of the cavity.

In an alternative embodiment, the relationship of the cavity in the housing 106 and the external shape of the core 104 can vary and may not correspond to one another. For example, the cavity 118 and the core 104 can each have a conical shape. In another example, the cavity 118 may be cylindrical or tubular while the shape of the core 104 may be partially tubular or cylindrical and partially conical. The tubular or cylindrical portion of the core 104 may keep the core 104 aligned in the cavity 118 while the conical portion of the core 104 may be used as a point of control of the switching device 100. The core 104 and cavity 118 can each have a variable cross-sectional profile from a first end to a second end of each, where the cross-sectional profiles match to allow for rotation with respect to each other.

The shape of the cavity 118 in the housing 106 and the shape of the core 104 allow the core to provide a contactless interface such that the switch can be sealed without contact in at least one embodiment. For instance, the core 104 and the housing 106 are configured to allow the core 104 to rotate within the cavity 118. The surface of the core 104 is thus adjacent an interior wall of the housing that defines the cavity 118. The magnetic fields of the core 104 and the housing 106, however, allow the core 104 to self align according to the magnetic poles. As discussed in more detail below, this allows the switching device 100 to provide a contactless seal, by way of example only and not limitation, in fluidic and pneumatic applications.

Advantageously, the magnetic fields can be configured to provide a substantially contactless interface. As discussed below, a gap 116 may be present around the circumference of the core 104. This contactless interface between the core 104 and the housing 106 allows the core 104 to rotate within the housing 106 (or in the cavity 118) with substantially less friction.

Figure 2:
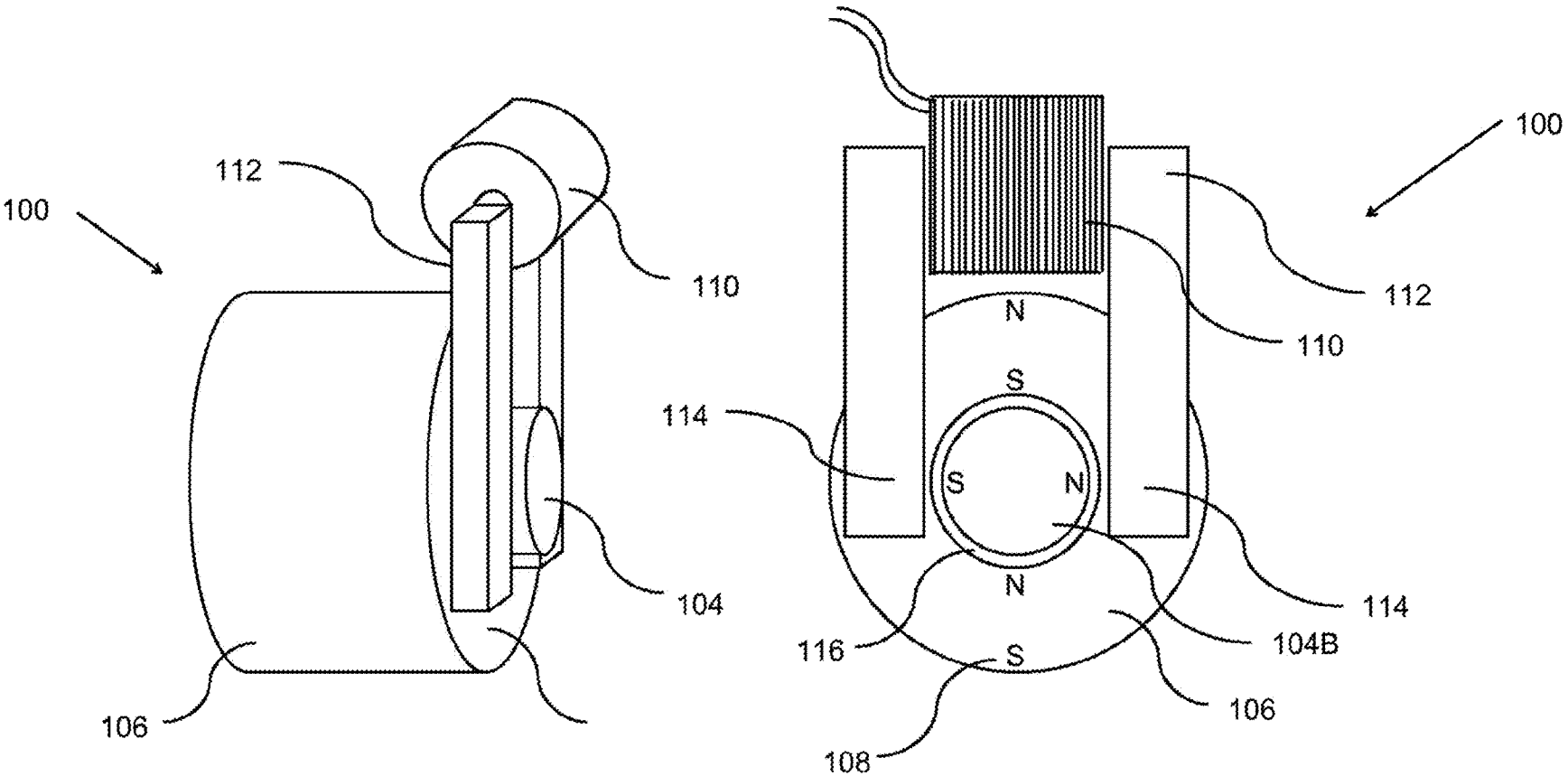
FIG. 2 illustrates a perspective view and a side view of the switch in an energized state.

The core 104 and the housing 106 naturally orient themselves according to aligning poles 108, identified by North (N) and South (S) symbols in FIGS. 1 and 2. FIG. 1 illustrates the switch in a natural state, where the magnetic poles of the core 104 are attracted to the corresponding magnetic poles of the housing 106. In the natural state, the switching device 100 is generally not energized.

FIG. 1 further illustrates that the switching device 100 may include an armature 112 with a coil 110. The armature 112 and/or coil 110 are typically fixed to the housing 106 of the switching device 100. The connection can be, by way of example, mechanical fasteners (e.g., screws, bolts), epoxy, welding, and the like. The armature 112 and coil 110 are an example of an energizing device. The energizing device can control a position of the core within the cavity formed in the housing. The position can be controlled, by way of example, only, rotationally and/or laterally.

In one example, the armature 112 and/or coil 110 may include a cap that is configured to engage with an end of the housing 106. The housing 106 may have a groove or other structure that engages with complementary structure in the cap to secure the cap, and thus the coil 110 and armature 112 in place. The complementary engagement structures may also have rotational structure to ensure that the placement of the armature 112 relative to the core 104 and housing 106 is correct to ensure proper operation of the switching device 100. The armature 112 may also be attached to the housing 106 by a pressure sensitive adhesive, UV curing adhesive, and the like, placed between the housing 106 and the armature 112.

When the coil 110 is energized, North and South poles 114 can be created in the armature 112. The magnetic force generated by the coil 110 is preferably designed to overcome the magnetic energy required to retain the core in its natural state 104A. When the coil 110 is energized and the magnetic field of the armature 112 is sufficient, the core 104 rotates within the cavity 118 to an energized state 104B, as illustrated in FIG. 2.

In the energized state 104B, the magnetic poles of the core 104 are aligned with the magnetic poles 114 generated within the armature 112, as illustrated in FIG. 2. When energy to the coil 110 is removed, thereby removing the magnetic field generated by the armature 112, the magnetic fields of the core 104 and the housing 106 cause the core 104 to return to the natural state 104A, as illustrated in FIG. 1. When the energy is removed from the coil 110, the core 104 can rotate in either direction to return to the natural state 104A. Alternatively, the core 104 can be configured to rotate in one rotational direction (e.g., clockwise or counter clockwise) when the coil 110 is charged, and then rotate the other rotational direction when the coil 110 is not charged. In another aspect, the core 104 can be configured to always rotate in one direction (e.g., clockwise or counterclockwise when the coil is charging, charged, discharging, or uncharged).

In one example, the housing 106 is typically held in location or fixed while the core 104 is able to alter its position relative to the magnetic field 114 generated in the armature 112. Thus, the body 102 or the housing 106 may include means for connecting to a surface of an apparatus. Alternatively, the core 104 may be fixed while the housing 106 is free to move (e.g., rotate). In this example, the core 104 is configured to rotate within the housing 106 in response to the magnetic fields being applied as discussed herein.

For example, one coil/armature may rotate the core 104 (or otherwise move or translate the core 104) by 45 degrees while another coil/armature, when energized, may rotate the core 104 by 90 degrees. One of skill in the art can appreciate that other movements or degrees of displacement or rotation can be achieved by the orientation of the coil/armature relative to the core 104 and housing 106. As previously mentioned, the core 104 can rotate in either direction according to the magnetic force being applied.

Further, embodiments of the invention may contemplate multiple coils and multiple armatures to rotate the core 104 by specific amounts. For example, the various armatures can be arranged to rotate the core 104, by way of example and not limitation, in steps (30 degree steps, 45 degree steps, etc.). Specific angles of rotation can be 5, 10, 15, 20, 25, 30, 35, 40, 45, 50, 55, 60, 65, 70, 75, 80, 85, and 90 degrees, or any angle therebetween. Embodiments of the invention further contemplate both rotational movement and/or translational movement of the core 104 relative to the housing 106.

In another embodiment, the energy applied to the coil 110 can be controlled. As illustrated in FIGS. 1 and 2, the armature 112 is configured to rotate the core 104 approximately 90 degrees. By varying the energy applied to the coil 110, the rotation of the core 104 can be controlled. As a result, the core 104 can be caused to rotate to any position between 0 and about 90 degrees. In some instances, this may allow the switching device 100 to control, by way of example only, fluid flow in a varying manner. Alternatively, the ability to variably control the rotation of the core 104 can allow the switching device 100 to provide multiple contact points for electrical connections at different positions. Thus, rotation of the core 104 (and/or of the housing 106) can be achieved using a variably energized coil and/or through the use of multiple armatures.

As previously stated, embodiments of the switching device 100 include multiple aligning poles 108, 114. Multiple aligning poles can create an indexing function and/or enhanced alignment. With no energy applied to the coil 110, the switch remains in its natural state 104A with the magnetic poles of the core 104 attracted to the corresponding magnetic poles within the housing 106. Thus, the switches or switching devices disclosed herein can automatically align themselves in a natural state 104A, move to an energized state such as energized state 104B and return themselves to their natural state after energy is removed. Because the core 104 may align itself within the housing 106, which may be circular in nature, the core 104 may be able to rotate about an axis that provides substantially frictionless rotation.

Additionally, the switching device 100*a* can include or be operably coupled to a controller that controls the amount of energizing (e.g., amount of electricity) that is provided to the coils 110 of the one or more armatures 112*a*. When only one armature is used, the amount of energy applied to the coil under control of the controller can control the amount of energizing, which controls the rate of change from the natural magnetic state to the energized magnetic state. The stronger the energized state, the faster the rate of change from the natural magnetic state to the energized magnetic state, and thereby the faster the change from the position of the core from the natural position of the natural magnetic state to the energized position of the energized magnetic state. While the angle between the natural position and the energized position can be 90 degrees, and angle or number of angles for multiple energized positions can be employed as described.

The controller that controls the energizing of the coil and generation of the energized magnetic state can be configured to selectively time the duration of energizing that facilitates the core changing from the natural position to the energized position. In some instance, the controller can control the energizing of the coil such that the core changes from the natural position to some arbitrary or defined position without fully reaching the fully energized position of the armature 112, and then the controller shuts off the energizing so that the core stops at some position, such as some angle, without fully moving or rotating the fully energized position. The selective "on," "off," or power of energizing the coil can then be used to control the change in position of the core, such as change from the natural position to an arbitrary or defined position, such as an arbitrary angle or defined angle from the natural position.

In one embodiment, the controller can be configured to rotate the core 104 from the natural position to any defined position or angle in any sequence. For example, the core can be selectively rotated from 0 degrees (e.g., natural position) to 45 degrees, to 30 degrees to 60 degrees, to 45 degrees to 75 degrees, then to 90 degrees. The selective rotation can also be to any sequence of angles from 0 to 180 degrees or even to 360 degrees.

Figure 2A:
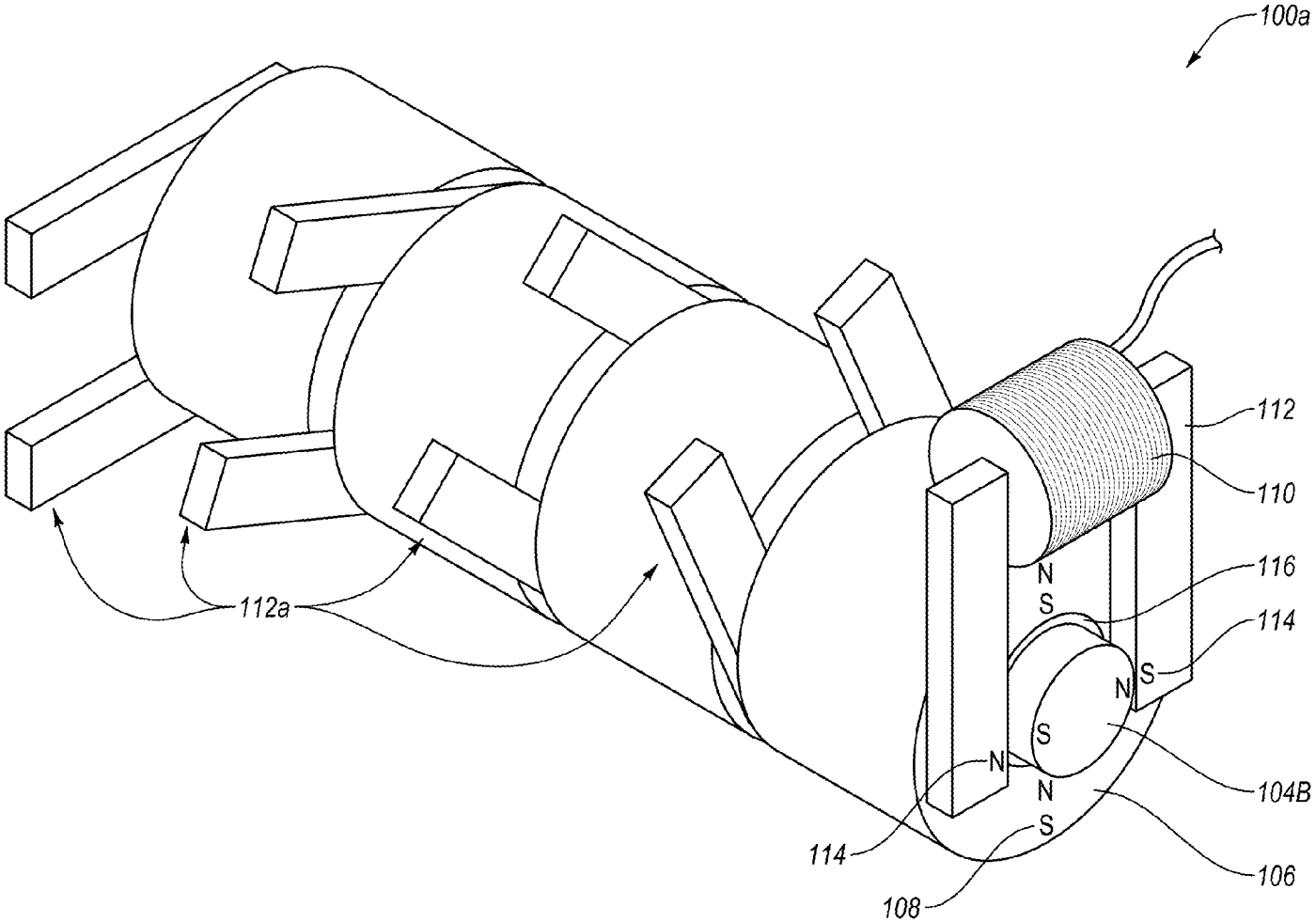
FIGS. 2A-2D illustrates embodiments of switching devices having multiple armatures.

FIG. 2A illustrates a switching device 100*a* that includes a plurality of armatures 112*a*, which are shown with dashed lines. Here, each armature 112*a* includes a coil (not shown) as shown with armature 112. The coils are the same as coil 110 for armature 112. All of the coils can be operably coupled to an energizing system or energizing controller as described so that the armatures 112*a* can be energized and create magnetic poles therein. As in FIGS. 1 and 2, the switching device 100*a* can include a first armature 112 that has magnetic poles when energized at some angle with respect to the magnetic poles of the housing 102. For example, the first armature 112 can have the magnetic poles when energized being 90 degrees from the magnetic poles of the housing 102. Any number of additional armatures 112*a* can then be included at any desired angles or combination of angles. The change in angle between the armatures can be the same or different. For example, as shown in FIG. 2A, the armatures 112*a* can be at angles 0 degrees, 22.5 degrees, 45 degrees, 67.5 degrees and 90 degrees, which are evenly spaced intervals between angles. However, the angles could also be at 0 degrees, 35 degrees, 45 degrees, 60 degrees and 90 degrees, or any other angle intervals. Additionally, while not specifically illustrated, the armatures can be arranged from 0 to 180 degrees or even 1 to 360 degrees or any angle or angle interval therebetween. Also, the same armature can be used to provide different angles. For example, the same armature can be used for 90 degrees and 270 degrees, where the polarity can be switched. In any event, the core 104 rotates to align with the magnetic poles of the armature 112*a* that is energized. It should be understood that each armature 112*a* can include its own coil 110 and energizing componentry, and one or more controllers can control the energizing.

Figure 2B:
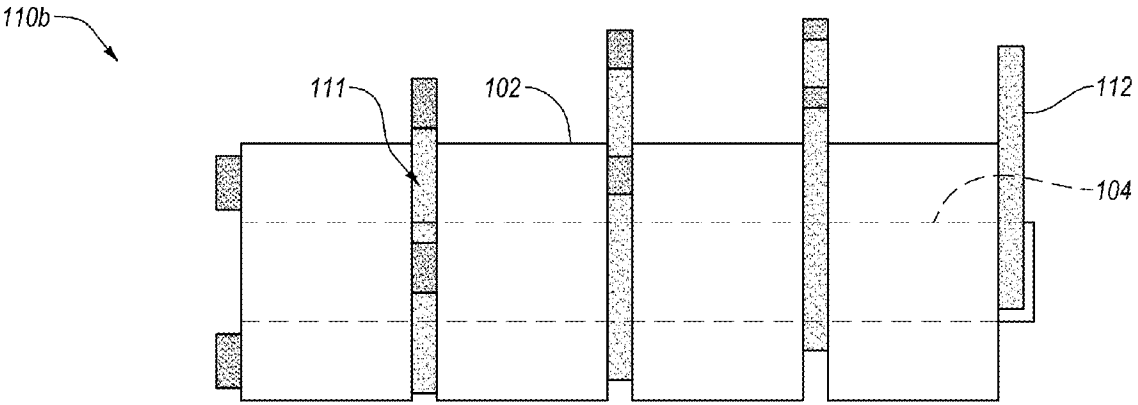
Figure 2C:
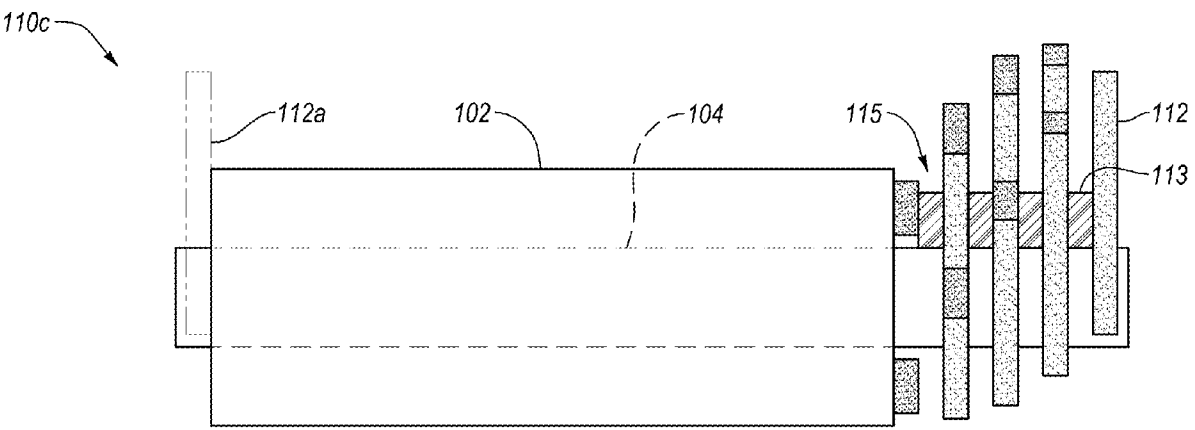
Figure 2D:
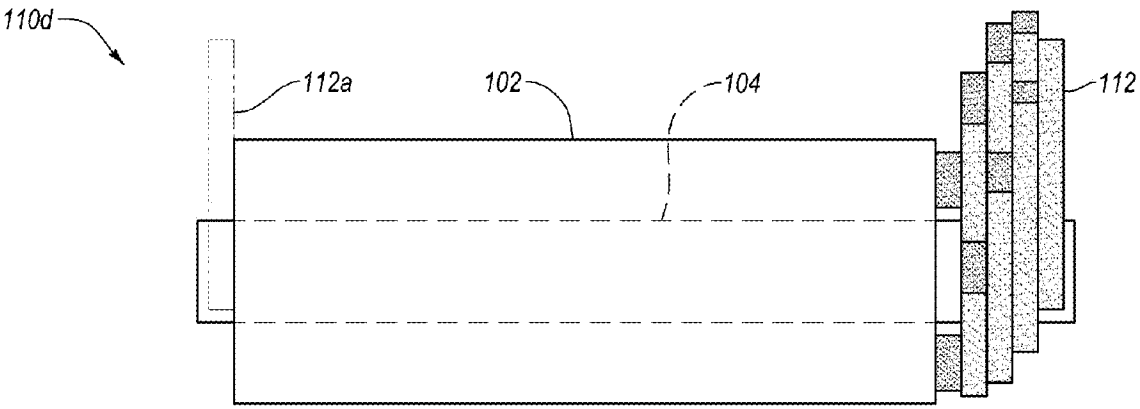

FIGS. 2B-2D illustrate different arrangements of a plurality of the armatures 112 with respect to the housing 102 and core 102. Again, the armatures 112 are shown without the coils for easier viewing of the orientation and relative rotation of the armatures 112. FIG. 2B shows the different armatures 112 (e.g., at angles with respect to each other as described herein) through the housing 102 or with housing portions 102 between each armature. For example, the armatures 112 can be received into slits 111 in the housing 102. FIG. 2C shows all of the armatures 112 at one end, separated by a member 113 (e.g., the member 113 can be used to bond the armatures 112 together), which leaves a gap 115 between the armatures 112. The member 113 may be an electrical insulator or conductor. FIG. 1D shows the armatures 112 all attached to each other and the housing 102. Both FIGS. 2C and 2D show that the other end of the housing 102 can include another armature 112*a*, which can be a 90 degree or main armature.

In one example, the core 104 may rotate without touching the interior wall of the housing 106. This contributes to the low power required to operate the electromechanical switch. More specifically, using current manufacturing methods, the gap 116 between the core 104 and the housing 106 can be controlled to tight tolerances. The nature of the magnetic forces in the switching device 100 results in a natural alignment of the core 104 to the center axis of rotation for the housing 106. This feature can be leveraged to create a low power precision switch or switching device for several applications.

Figure 3:
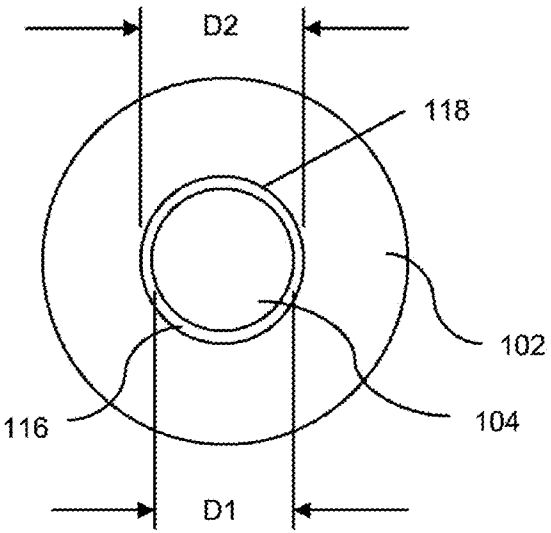
FIG. 3 illustrates a gap between a core and a housing of a switch.

For example, the switching device 100 may be employed in a gas valve application. In this example, the ability to provide tight manufacturing tolerances can prevent leakage of the gas from the switching device 100. For example, no leak will occur for all gasses, excluding hydrogen, if the gap 116 between the core 104 and the housing 106 can be controlled to the relationship 0.0001 inches$\leqq$D2−D1$\leqq$0.0003 inches as illustrated in FIG. 3. D2 is a diameter of the cavity in the housing 106 and D1 is a diameter of the core 104 in this example. Due to the balanced magnetic forces that exist in the multiple poles of the switching device 100, the gap 116 will be uniform around the core 104 as it is naturally centered in the housing 106.

In one example of a fluidic application, the gap 116 can be manufactured to maintain the relationship of D2−D1 to be less than 0.0001 inches. The lower limit of 0.0001 inches is the maximum gap allowed to seal against hydrogen gas. All other gasses can usually be sealed by limiting the gap to a maximum of 0.0003 inches. For liquid applications, the viscosity of the fluid can be adjusted to prevent leakage or slow operation. Additionally, the active surfaces of the switching device (e.g., a valve) can be treated lyophobicly to prevent fluid from wicking into the gap 116.

Figure 4:
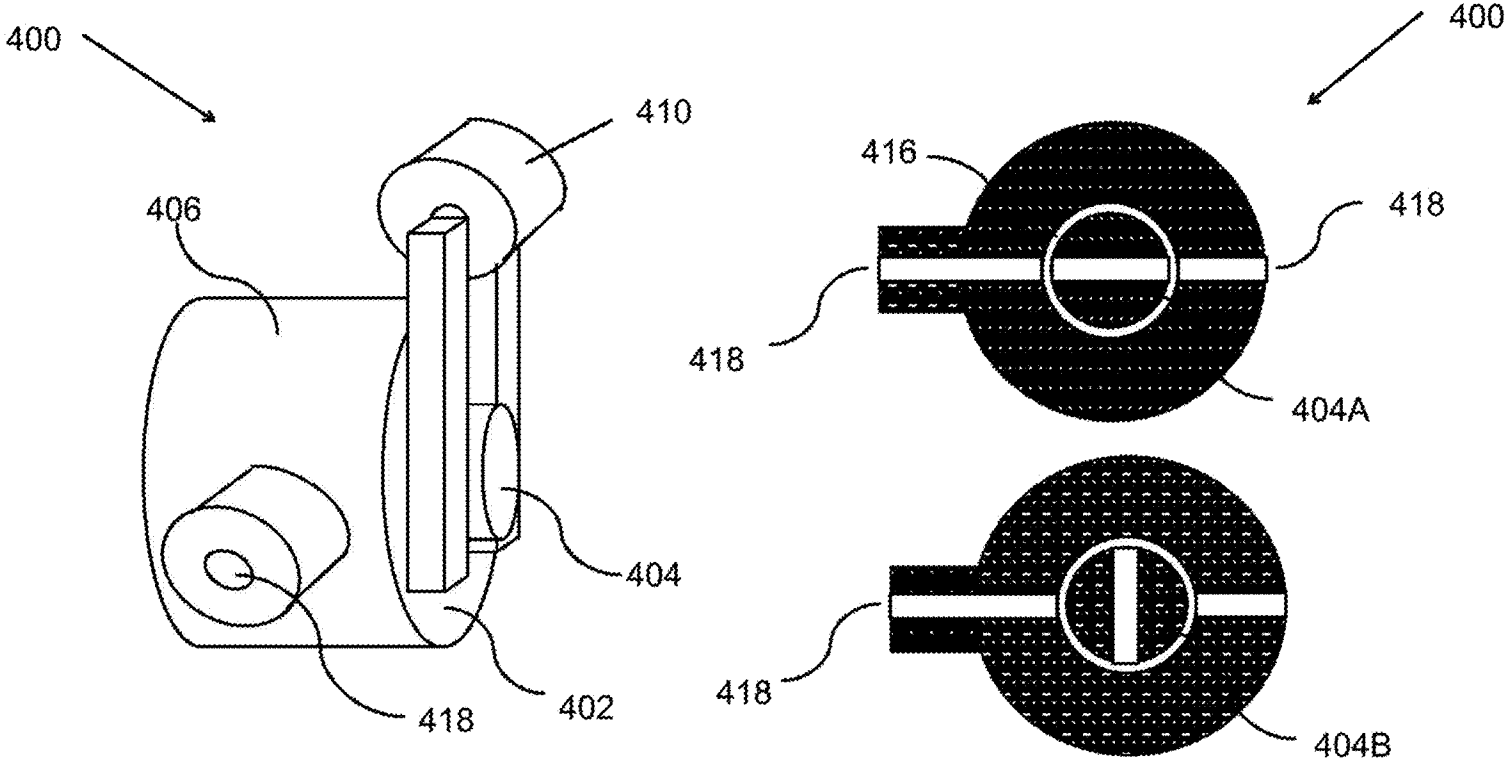
FIG. 4 illustrates a perspective view and a cross sectional view of a switch configured for a fluidic application.

FIG. 4 illustrates an example of an electromechanical switch 400 in a fluidic application (such as a gas) from a perspective view and in a cross sectional view along a port hole 418. The switch 400 is an example of the switching device 100 and includes a housing 402 and a core 404. In this example, the port hole 418 is formed (e.g., through the center) through the housing 406 and core 404. In this example, the port hole 418 runs substantially orthogonal to the axis of rotation of the core 404, although the port hole 418 can be arranged in another configuration and axis.

In a 'normally open' configuration of the switch 400, fluid can flow freely through the valve in the natural state 404A or energy off condition. In other words, fluid can flow through the port hole 418 because the core 404 is arranged to permit fluid flow through a bore or hole formed in the core 404.

When a coil 410 is energized, the core 404 is rotated 90 degrees in this example to the energized state 404B, thereby blocking the fluid flow through the switch 400.

For a normally closed configuration of the switch 400, the poles of the core 404 are offset 90 degrees relative to the poles of the core 404 in the normally open configuration of the switch 400, resulting in a power-off or natural state of closed. In other words, the orientation of the poles of the core 404 relative to the port hole 418 can determine whether the switch 400 (e.g, a valve) is open or closed when no energy is applied to the coil 410.

The size of the port hole 418 can vary according to a desired flow or flow rate. The flow rate can be controlled, for example, by a size of the bore or hole that forms the port hole 418.

Figure 5:
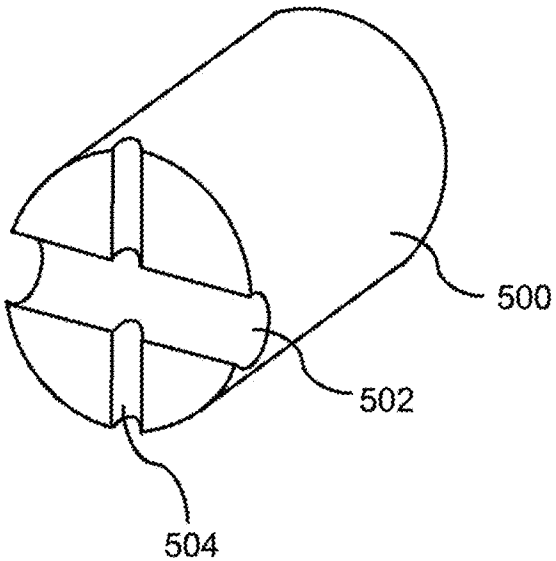
FIG. 5 illustrates a perspective view of a core with multiple ports formed therein.

FIG. 5 illustrates another example of a core 500 that can be used in embodiments of the switch or switching devices disclosed herein to control fluidic flow. The core 500 illustrated in FIG. 5 can provide a slow leak. In this example of the core 500, the core 500 may include a port 502 and a port 504. The port 502 has a larger cross sectional area than the port 504. As a result, the flow of fluid is different for the two port holes 502 and 504.

When a switch (e.g., the switch 400) is energized, for example, the fluid may flow freely through the port 502. When energy is removed from the switch, then the switch provides a slow leak through the port 504 and fluid flow is more restricted compared to the port hole 502. This may be useful for various kinds of fluid including gaseous fluids and liquid fluids. The port 504, by way of example only, may have a diameter on the order of 0.01 inches while the port 502 may have a larger diameter.

In addition, the ports 502 and 504 are typically substantially orthogonally positioned relative to each other in one example. Further, the fit or gap between the core 500 and the housing of the switch substantially is configured such that the fluid does not typically leak from the port that is not aligned. For example, when the port 504 is aligned for fluid flow, the interface between the port 502 and the interior wall of the housing prevents additional fluid leak at that point from the port 502.

Figure 6:
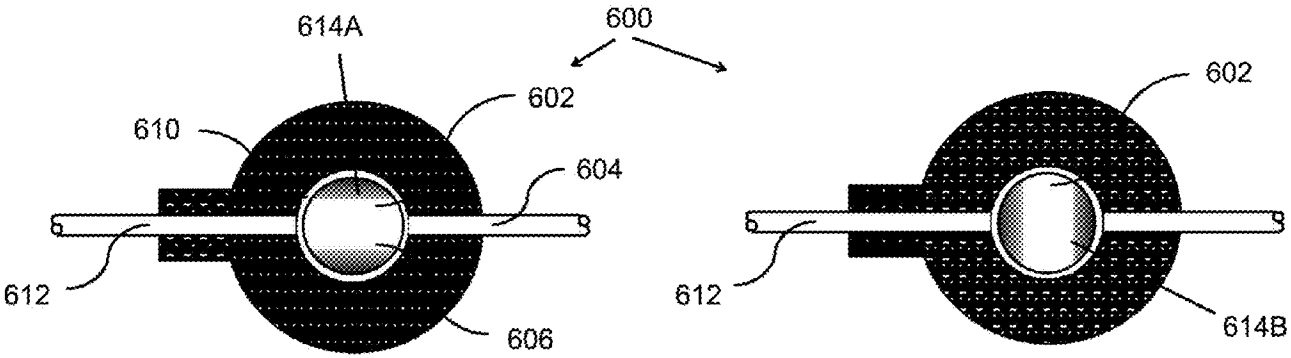
FIG. 6 illustrates a cross sectional view of a switch configured for an optical application.

FIG. 6 illustrates an example of a switch 600 in an optical application. The switch 600 is an example of the switching device 100. In this example, a spherical lens 602 (or other optical element) can be attached to the center of axis on the core 606. An optical fiber 612 can be inserted into the housing 610 of the switch 600 similar to the ports on the valve design described previously. Energizing the coil of the switch 600 rotates the lens 602 from position 614A to position 614B, blocking the light traveling in the optical fiber 612. The magnetic forces naturally position the core 606 to the ideal center of rotation, significantly reducing manufacturing costs associated with alignment. As previously stated, the lens 602 or other optical assembly can be arranged in the core 606 such that the energized state of the coil can allow or block light.

Figure 7:
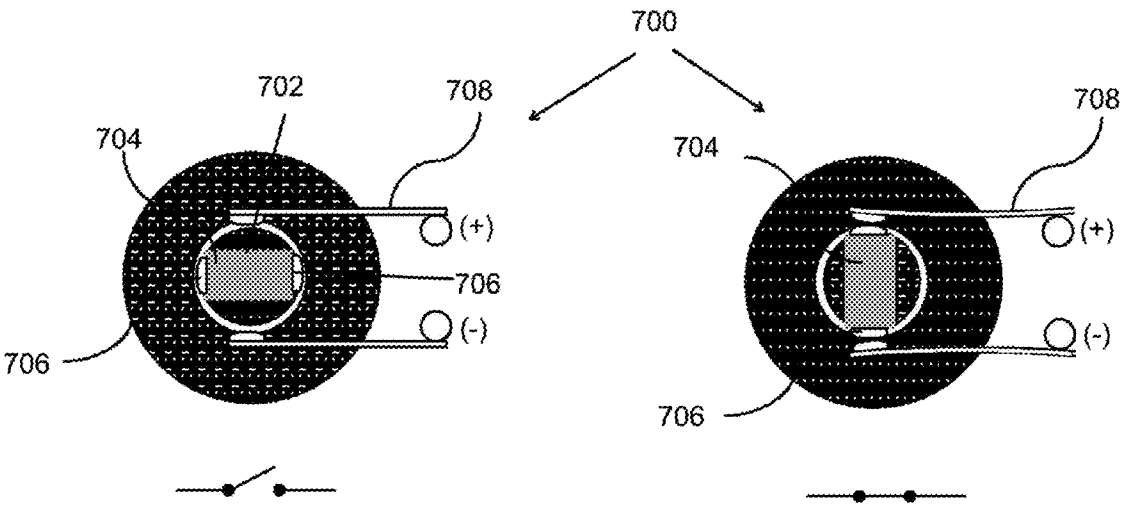
FIG. 7 illustrates a cross sectional view of a switch configured for an electrical application.

FIG. 7 illustrates an example of a switch 700 in an electrical application. The switch 700 is an example of the switching device 100. In an electrical switch application, a core 702 can contain a buss type conductor 704 or similar, with or without a contact(s) 706. As the core 702 is rotated, as previously described, the contacts 706 will engage with a desired wiping action or other type of mechanical engagement to establish an electrical connection. Similar to a motor stator, an electrical switch may include a spring 708 design to engage and hold the contacts 706 closed. Such a design may require higher power to operate the switch 700. Spring designs can be created that will either require or not require power to maintain electrical connection.

FIG. 8 illustrates another example of a switch 800, which is an example of the switching device 100. The switch 800 includes a housing 802 and a core 814. In this example, however, the core 814 has a length that allows the core 814 to translate laterally within the cavity of the housing 802. The magnetic fields are at the ends of the housing 802 and core 814 in this example, as illustrated by magnetic fields 812.

When the coil and armature (collectively 804) is not energized, the core 814 is in a natural state 810 within the housing 802. Because the core 814 has a shorter length compared to a length of the cavity in the housing 802, the natural state 810 of the core 814 is naturally centered in the cavity of the housing 802 according to the magnetic fields 812 of the switch 800.

A pull state 808 is illustrated when the coil 804 is energized in FIG. 8. The switch 800 can also be configured to enter a push state 822. In the pull state 808, the magnetic field generated by the coil 804 attracts the core 814 and overcome the magnetic fields of the housing 802 and the core 814 to pull the core 814 towards the coil/armature 804 end of the switch 800. Of course, the coil/armature 804 can also be configured to generate a magnetic field to push the core 814 away as illustrated by the push state 822.

The switch 800 illustrated in FIG. 8 may also have a gap as previously described and may be operated in a fluidic application, pneumatic application, electrical application, optical application, and the like. Specifically, the items 816 and 818 can be contacts, ports, optical fibers, and the like or any combination thereof. The core 814 may be similarly configured as previously described herein with optical elements, contacts, holes, and the like. One or more additional items (port, contact, etc.) may be behind the core 814.

Although FIG. 8 illustrates that the core 814 is between the items 816 and 818, the core 814 may have a length (or the items 816 and 818 may be positioned) such that at least one is covered by the core 814 when in the natural state 810. One of skill in the art can appreciate, with the benefit of the present disclosure, that the items 816 and 818 can be configured such that the core 814 may by located to cover or contact or interface with one or more of the items in any of the natural or energized states.

Further, the field generated by the coil/armature 804 can be reversed such that at least three states are possible. As a result, both items 816 and 818 could be open in the natural state or one of the items 816 and 818 can be covered as illustrated by the energized states.

Figure 9:
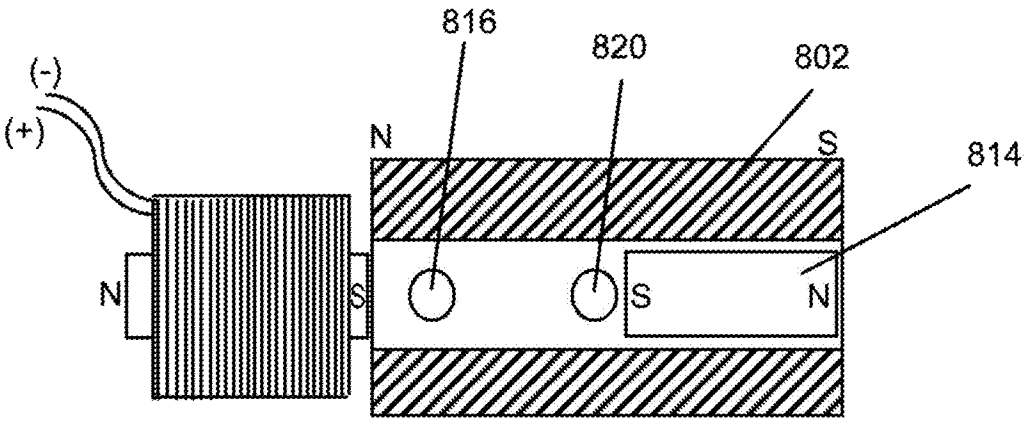
FIG. 9 illustrates an example of a three way switch with a core that translates at least laterally.

FIG. 9 illustrates an example of a switch 900 that can be a three way switch. The switch 900 is an example of the switch 800. By energizing the switch 900 to push or pull the core 814 to different locations within the cavity of the core 802, at least three states can be achieved with the switch in FIG. 9. The items 816, 818, and 820 can be connected in different configurations by the core 814. For example, the core 814 can connect items 820 and 818, connect items 816 and 820, or not connect any of the items 816, 818, and 820.

The switches or switching devices described herein may not have parts that degrade or wear due to port sealing load condition (e.g., loads that occur when a port is sealed such as mechanical binding, etc.). In some embodiments, the interface between the core and the housing is contactless and the core is automatically aligned by the magnetic fields.

In addition, the switches have minimal or no drag, minimal structural loading, are frictionless or substantially frictionless, and can be operated in low power or ultra low power modes. Further, the switches self align using the magnetic field. Also, the switches can be manufactured less expensively. Some embodiments of the invention eliminate springs that increase the electromagnetic forces required to open or close the switch.

Figure 10A:
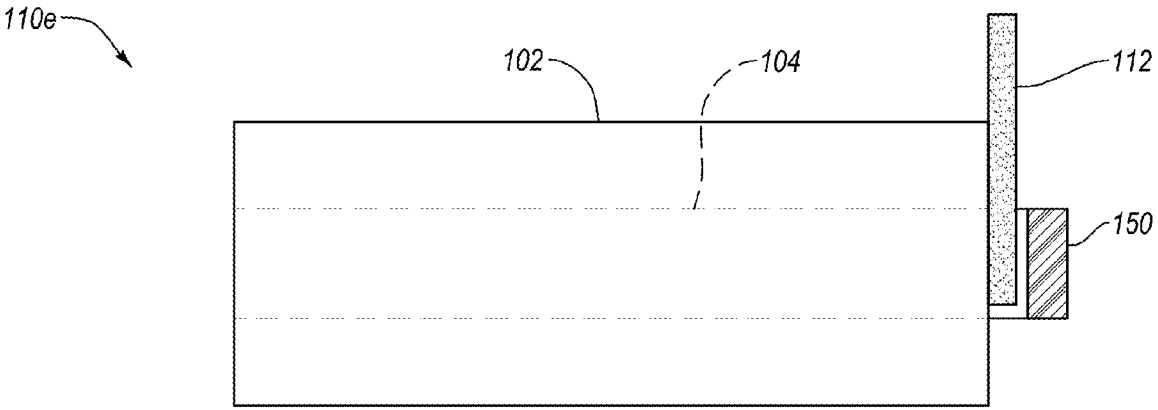
FIGS. 10A-10C illustrate embodiments of switching devices include at least one mirror element coupled to the core.
Figure 10B:
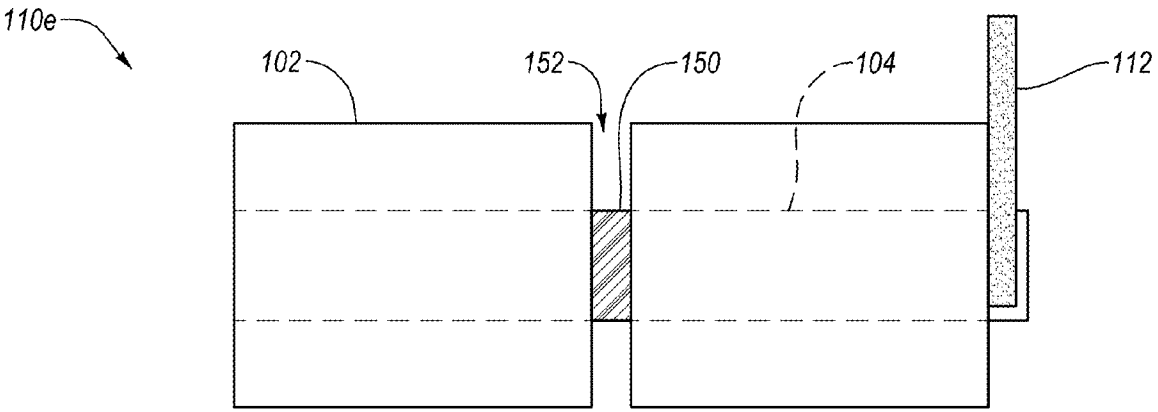
Figure 10C:
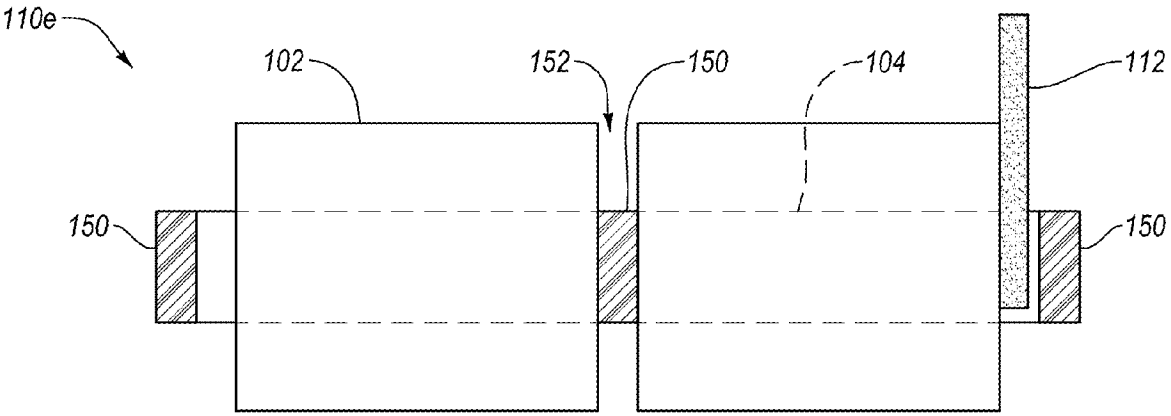

FIGS. 10A-10B illustrate an embodiment of a switching device that includes a mirror element 150 attached to the core 104. Again, the armature 112 is shown without the coil for easier viewing. When the core 104 rotates, the mirror 150 rotates. This can be used for scanning methods when a laser is pointed at the mirror 150. Accordingly, the switching device can include a laser operably coupled thereto. Also, the switching device can be included in a device, such as a scanning device, that also includes a laser. Moreover, the device having the switching device can include multiple lasers when multiple mirror elements 150 are coupled to the core 104. FIG. 10A shows one mirror element 150 at the end of the core 104. FIG. 10B shows a mirror element 150 at a middle portion of the core 104 that is exposed by a gap 152 in the housing 102. The gap 152 can also be a slit as described herein, where the housing 102 can be a single integrated housing 102 or two or more housing 102 members coupled together. Multiple intermediate or middle mirror elements 150 can be used on a single core within the housing 102 with a gap 152 for each mirror element 150. FIG. 10C shows a mirror element 150 on each end of the core 104, and one mirror element 150 in the middle of the housing 102 exposed by a gap 152 in the housing 102.

Figure 11:
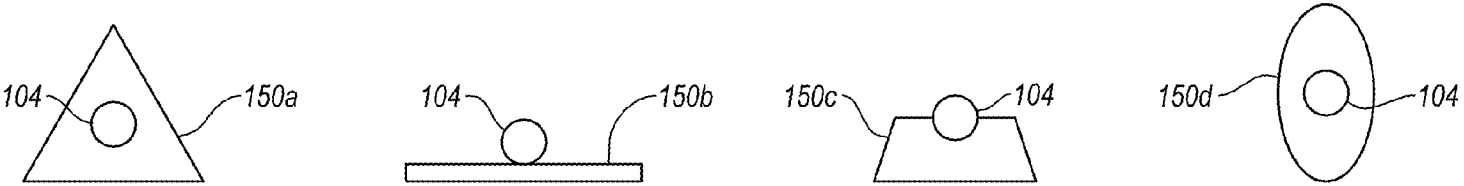
FIG. 11 illustrates embodiments of mirror elements coupled to the core.

The mirror element 150 can be configured into any shape as desired, or can include one or more mirror surfaces that reflect light, such as a laser light. FIG. 11 illustrates a few samples of the possible configurations and shapes of the mirror elements 150 having one or more mirror surfaces. Mirror element 150*a* is a triangle member with three mirror surfaces, where the core 104 is located in the center of the mirror element. Here, all three surfaces can be flat; however, one surface can be flat, one surface can be concave, and one surface can be convex. The mirror element 150 can be used with one, two, or three different lasers for single or multiple scanning operations. FIG. 11 also shows a planar mirror element 150*b* with one mirror surface and the opposite surface being coupled to the core 104, such that when the core 104 rotations, the mirror surface rotates to change the angle of reflection of an incident laser. FIG. 11 also shows a trapezoidal mirror element 150*c*, where the core 104 is located and embedded within surface. The trapezoidal mirror element 150*c* can include one or more mirror surfaces. FIG. 11 also shows an oval mirror element 150*d*, where the core 104 is located in the center. The oval core 104 can be selectively rotated at select portions of the surface in order to change the angle the light is reflected.

Additionally, the switching device can be mounted to a mechanical component that can move the switching device in one or more dimensions. For example, the switching device can be mounted to a rail that can slide the switching device in a direction along the center cavity longitudinal axis. The mechanical device may also be able to move the switching device lateral, as well as up or down. Any mechanical movement in any direction can be used. For example, when a scanning device, the core can rotate the mirror and the mechanical component can move the switching device in order to scan an article from side to side and top to bottom.

In one embodiment, a switching device can include: a housing having a body defining a cavity formed therein with a circular cross-sectional profile and with a first cavity lateral axis that intersects and is orthogonal to a second cavity lateral axis on the cross-sectional profile and with a centered cavity longitudinal axis that intersects and is orthogonal to the first cavity lateral axis and second cavity lateral axis, wherein the first cavity lateral axis intersects the housing body at opposite housing magnetic poles with respect to the centered longitudinal axis; a core having a body with cross-sectional profile that is smaller than and matches the cavity cross-sectional profile placed in the cavity such that a centered core longitudinal axis aligns with the centered cavity longitudinal axis and that there is an annular gap between the core body and housing body, the core body having opposite core magnetic poles on a core lateral axis that are magnetically aligned with the housing magnetic poles when in a natural magnetic state;

an armature connected with the housing such that opposite armature magnetic poles are aligned with the second cavity lateral axis, wherein the core magnetic poles are magnetically aligned with the armature magnetic poles when in an energized magnetic state; and a coil wound around the armature between the opposite armature magnetic poles, wherein the coil generates a magnetic field in the armature that rotates the core from the natural magnetic state to the energized magnetic state when the coil is energized, wherein the core returns to the natural magnetic state when the coil is not energized.

In one embodiment, the switching device can include: the housing being formed of a magnetic material; the core being formed of the magnetic material; and the housing and the core being aligned to the natural magnetic state automatically by poles of the magnetic material.

In one embodiment, the switching device can include a magnetic field generated in the armature being sufficiently strong to move the core from the magnetic natural state to the energized magnetic state.

In one embodiment, the switching device can include the core being capable of rotating about 90 degrees when rotating from the natural magnetic state to the energized magnetic state, or any angle therebetween. That is, the magnets can be set at any angle for any angle of rotation.

In one embodiment, the switching device can include a gap between the entire core and the housing. The core centers itself within the cavity at the cavity longitudinal axis and facing surfaces. The core and the housing can be substantially or completely contactless in the natural magnetic state and energized magnetic state. As such, the annular gap can be within a range of about 0.0001 inches and 0.0003 inches. Also, the annular gap can be less than or equal to 0.0001 inches.

In one embodiment the switching device can include a housing port formed in the housing and can be aligned with a core port formed in the core when in either the natural magnetic state or the energized magnetic state and not aligned in the other magnetic state. The housing port and core port can be configured for one of a fluidic application, a pneumatic application, or an optical application. For example, the core, when the housing port and core port are not aligned, can provide a contactless seal for the housing port.

In one embodiment, the switching device can include an optical element disposed in the core port. The optical element can be any optical element, such as a fiber optic, lens, collimator, diffusor, prism, or the like. When the housing port and core port are aligned, light passes through the core port in one of the natural state or the energized state, and no light passes through the core port when not aligned with the housing port.

In one embodiment, the core port can be configured to become self-aligned with the housing port when in the natural state or when in the energized state. Magnetic configurations can be adapted for the capability of having self-alignment.

In one embodiment, a surface of the core and/or an interior wall surface of the cavity of the housing can be treated lyophobicly.

In one embodiment, the core can include electrical contacts that electrically engage with corresponding electrical contacts mounted to the housing. This can be beneficial when the core is configured for an electrical application. The electrical engagement can be facilitated when in at least one of the natural state or the energized state, or state therebetween.

In one embodiment, a longitudinal length of the core can be less than a longitudinal length of the housing. As such, the magnetic field can push and/or pull the core inside of the cavity. The core can oscillate from being pushed to pulled depending on the electronic state.

In one embodiment, a switching device can include: a housing having a body defining an elongate cavity formed therein with a circular cross-sectional profile and with a centered cavity longitudinal axis extending between opposite housing magnetic poles at opposite ends of the elongate cavity; an elongate core having a body with cross-sectional profile that is smaller than and matches the cavity cross-sectional profile arranged in the cavity such that a centered core longitudinal axis aligns with the centered cavity longitudinal axis and that there is an annular gap between the core body and housing body, the core body having opposite core magnetic poles at opposite ends that are magnetically aligned with the housing magnetic poles such that the core is centered between the housing magnetic poles at a natural magnetic state position when in a natural magnetic state, the core being capable of translating along the centered cavity longitudinal axis to a pull magnetic state position and to an opposite push magnetic state position; and at least one energizing device adjacent to at least one end of the cavity of the housing and operably coupled with a first end of the core, wherein the energizing device controls a position of the core inside of the cavity, when the energizing device is not energized the core is at the natural magnetic state position, when the energizing device is energized to a pull energized state the core is in the pull magnetic state position proximal the energizing device, when the energizing device is energized to a push energized state the core is in the push magnetic state position distal the energizing device.

In one embodiment, the core can include one of a fluidic element, an optical element, an electrical element, or a mirror element. These elements can be positioned at any position on the core, such as on a portion of the core that extends from the housing. Also, the housing can include a slit that aligns with the element. The energizing device can controls the position of the core to change a state of the element. That is the energizing device can be controlled to control the position of the fluidic element, the optical element, mirror element, or the electrical element with respect to the housing. The change of position by the core can change the position of the element.

In one embodiment, the core and the cavity can each have a circular cross section, wherein the core has a contactless interface with the cavity. When a sliding core, and not a rotating core, the core and cavity can have matching polygonal, oval, or other cross-sectional shape that allows for liner translation along a longitudinal axis without rotation.

In one embodiment, a length of the core is shorter than a length of the cavity. In another embodiment, the length of the core is the same as the length of the cavity so that the surfaces of the core and housing align. In another embodiment, the length of the core can be longer than the length of the cavity so as to protrude therefrom.

In one embodiment, the energizing device can be configured to energize a coil to generate a magnetic field in an armature connected to the housing to overcome strength of the housing magnetic poles that naturally align the core. The energized coil can facilitate movement of the core, such as to move the core to pull magnetic state position or push magnetic state position within the cavity. The pull magnetic state or push magnetic state can be different from a natural state. The core can be in the natural state when the coil is not energized.

In one embodiment, the housing and/or the core can include a magnetic material. As such, the core and housing can be magnetically attracted so that the core and housing have a natural alignment when in the natural state, where the natural state is the natural magnetic alignment.

In one embodiment, the energizing device or multiple energizing devices can be configured to move the core to multiple positions relative to the cavity. In one embodiment, the core can include multiple holes that can be used as ports as described herein. Each hole or port can be dimensioned or otherwise configured for a different flow rate of fluid through the switching device. Also, the different holes can include different elements, such as different optical elements, different electrical elements, or different a mirror elements. Different optical elements can be different in how light propagates therethrough. Different electrical elements can, for example, have different resistivity, impedance, or other electrical parameter. The different mirror elements can be flat, concave, or convex.

In one embodiment, the device can include multiple energizing devices. Optionally, each energizing device can be operably coupled to an armature. The multiple energizing devices can step the core through multiple positions. Also, at least one energizing device can be configured to step the core through multiple positions, each position corresponding to a different state.

In one embodiment, a switching device can include: a housing having a body defining a cavity with a centered cavity longitudinal axis and a first cavity lateral axis, wherein the first cavity lateral axis intersects the housing body at opposite housing magnetic poles; a core having a body that is smaller than the cavity located in the cavity such that a centered core longitudinal axis aligns with the centered cavity longitudinal axis with a gap between the core body and housing body, the core body having opposite core magnetic poles on a core lateral axis that are magnetically aligned with the housing magnetic poles when in a natural magnetic state; an armature connected with the housing such that opposite armature magnetic poles are not aligned with the first cavity lateral axis, wherein the core magnetic poles are magnetically aligned with the armature magnetic poles when in an energized magnetic state; and a coil operably coupled with the armature so as to generates a magnetic field in the armature that transitions the core from a natural position of the natural magnetic state to an energized position of the energized magnetic state when the coil is energized, wherein the core returns to the natural position when the coil is not energized. In one aspect, the housing and core are configured to rotate with respect to each other between the natural position and the energized position or to any position therebetween. In one aspect, the energized position of the core is at an angle with respect to the natural position.

In one aspect, the housing and core are configured to slide along the centered cavity longitudinal axis with respect to each other between the natural position and the energized position or any position therebetween.

In one embodiment, the gap is between the entire core and the housing so as to be an annular gap. In one example, the annular gap is within a range of about 0.0001 inches (2.54 microns) and 0.0003 inches (7.62 microns). In another example, the annular gap is less than or equal to 0.0001 inches, or 0.00007 inches (1.78 microns), or 0.00005 inches (1.27 microns), or 0.00003 inches (0.76 microns). As such, the gap can be fabricated to be less than a micron. These dimensions are obtainable with modern manufacturing, such as with microelectro mechanical (MEM) devices.

In one embodiment, the device can include a housing port formed in the housing and aligned with a core port formed in the core when in either the natural magnetic state or the energized magnetic state and not aligned in the other magnetic state. The housing port and core port are configured for one of a fluidic application, a pneumatic application, reflective, or an optical application. In one aspect, the core, when housing port and core port are not aligned, provides a contactless seal for the housing port.

In one embodiment, the core includes electrical contacts that electrically engage with corresponding electrical contacts mounted to the housing when in at least one of the natural state or the energized state.

In one embodiment, the device can include one or more mirror elements coupled to the core. In one aspect, at least one mirror element is coupled to an end portion of the core that extends from the housing. In one aspect, the housing includes a slit or gap that exposes a middle portion of the core and at least one mirror element is coupled to the middle portion of the core so as to be optically exposed through the slit or gap.

In one embodiment, the device can include a plurality of armatures, each armature having a coil and opposite armature magnetic poles that are not aligned with the first cavity lateral axis. In one aspect, the plurality of the armatures can have a plurality of armature magnetic pole positions with respect to the housing magnetic poles. In one aspect, the plurality of armature magnetic poles are at different angles with respect to the housing magnetic poles.

In one embodiment, the switching devices described herein can be used for switching methods. Such as switching method can include: providing the switching device as described; and switching the switching device between the natural magnetic state and energized magnetic state. The switching method can include energizing the coil, and transitioning the core between the natural position and energized position. The switching method can include energizing the coil so that the core transitions from the natural position toward the energized position, and de-energizing the coil so that the core transitions back to the natural position.

In one embodiment, a device can include a switching device that has a mirror element as described herein; and a light source aligned with the mirror element. The light source can be a lamp, bulb, light emitting diode (LED), high intensity diode, halogen bulb, laser, or the like. In one aspect, the mirror element can be coupled to the core so as to transition therewith, such as rotational or longitudinal translation. In one example, at least one mirror element can be coupled to an end portion of the core that extends from the housing. In another example, the housing includes a slit or gap that exposes a middle portion of the core and at least one mirror element is coupled to the middle portion of the core so as to be optically exposed through the slit or gap.

In one embodiment, a method can include: providing a switching device as described herein; reflecting a light beam off of the mirror element; and switching the switching device between the natural magnetic state and energized magnetic state. Such a method can also include energizing the coil, and transitioning the core between the natural position and energized position. Also, the method can include energizing the coil so that the core transitions from the natural position toward the energized position, and de-energizing the coil so that the core transitions back to the natural position. This can also include scanning an article with the light beam The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A switching device comprising:

a housing having a body defining a cavity with a centered cavity longitudinal axis and a first cavity lateral axis, wherein the first cavity lateral axis intersects the housing body at opposite housing magnetic poles;

a core having a body that is smaller than the cavity located in the cavity such that a centered core longitudinal axis aligns with the centered cavity longitudinal axis with a gap between the core body and housing body, the core body having opposite core magnetic poles on a core lateral axis that are magnetically aligned with the housing magnetic poles when in a natural magnetic state;

an armature connected with the housing such that opposite armature magnetic poles are not aligned with the first cavity lateral axis, wherein the core magnetic poles are magnetically aligned with the armature magnetic poles when in an energized magnetic state; and a coil operably coupled with the armature so as to generates a magnetic field in the armature that transitions the core from a natural position of the natural magnetic state to an energized position of the energized magnetic state when the coil is energized, wherein the core returns to the natural position when the coil is not energized.

2. The switching device of claim 1, wherein the housing and core are configured to rotate with respect to each other between the natural position and the energized position.

3. The switching device of claim 1, wherein the housing and core are configured to slide along the centered cavity longitudinal axis with respect to each other between the natural position and the energized position.

4. The switching device of claim 1, wherein the gap is between the entire core and the housing so as to be an annular gap.

5. The switching device of claim 1, wherein the annular gap is within a range of about 0.0001 inches and 0.0003 inches.

6. The switching device of claim 1, wherein the annular gap is less than or equal to 0.0001 inches.

7. The switching device of claim 1, further comprising a housing port formed in the housing and aligned with a core port formed in the core when in either the natural magnetic state or the energized magnetic state and not aligned in the other magnetic state, wherein the housing port and core port are configured for one of a fluidic application, a pneumatic application, reflective, or an optical application.

8. The switching device of claim 7, wherein the core, when housing port and core port are not aligned, provides a contactless seal for the housing port.

9. The switching device of claim 1, wherein the core comprises electrical contacts that electrically engage with corresponding electrical contacts mounted to the housing when in at least one of the natural state or the energized state.

10. The switching device of claim 1, comprising one or more mirror elements coupled to the core.

11. The switching device of claim 10, wherein at least one mirror element is coupled to an end portion of the core that extends from the housing.

12. The switching device of claim 11, wherein the housing includes a slit or gap that exposes a middle portion of the core and at least one mirror element is coupled to the middle portion of the core so as to be optically exposed through the slit or gap.

13. A device comprising:

the switching device of claim 10; and a light source aligned with the mirror element.

14. A device comprising:

the switching device of claim 10; and a laser aligned with the mirror element.

15. The switching device of claim 1, wherein the energized position of the core is at an angle with respect to the natural position.

16. The switching device of claim 1, comprising a plurality of armatures, each armature having a coil and opposite armature magnetic poles that are not aligned with the first cavity lateral axis.

17. The switching device of claim 16, wherein the plurality of the armatures have a plurality of armature magnetic pole positions with respect to the housing magnetic poles.

18. The switching device of claim 17, wherein the plurality of armature magnetic poles are at different angles with respect to the housing magnetic poles.

19. A method comprising:

providing the switching device of claim 1; and switching the switching device between the natural magnetic state and energized magnetic state.

20. A method comprising:

providing the switching device of claim 1;

energizing the coil; and transitioning the core between the natural position and energized position.

21. A method comprising:

providing the switching device of claim 1;

energizing the coil so that the core transitions from the natural position toward the energized position and de-energizing the coil so that the core transitions back to the natural position.

22. A switching device comprising:

a housing having a body defining a cavity with a centered cavity longitudinal axis and a first cavity lateral axis, wherein the first cavity lateral axis intersects the housing body at opposite housing magnetic poles;

a core having a body that is smaller than the cavity located in the cavity such that a centered core longitudinal axis aligns with the centered cavity longitudinal axis with a gap between the core body and housing body, the core body having opposite core magnetic poles on a core lateral axis that are magnetically aligned with the housing magnetic poles when in a natural magnetic state;

at least one mirror element coupled to the core;

an armature connected with the housing such that opposite armature magnetic poles are not aligned with the first cavity lateral axis, wherein the core magnetic poles are magnetically aligned with the armature magnetic poles when in an energized magnetic state; and a coil operably coupled with the armature so as to generates a magnetic field in the armature that transitions the core from a natural position of the natural magnetic state to an energized position of the energized magnetic state when the coil is energized, wherein the core returns to the natural position when the coil is not energized.

23. The switching device of claim 22, wherein at least one mirror element is coupled to an end portion of the core that extends from the housing.

24. The switching device of claim 22, wherein the housing includes a slit or gap that exposes a middle portion of the core and at least one mirror element is coupled to the middle portion of the core so as to be optically exposed through the slit or gap.

25. A method comprising:

providing the switching device of claim 22;

reflecting a light beam off of the mirror element; and switching the switching device between the natural magnetic state and energized magnetic state.

26. A method comprising:

providing the switching device of claim 22;

reflecting a light beam off of the mirror element;
energizing the coil; and
transitioning the core between the natural position and energized position.

27. A method comprising:
providing the switching device of claim 22;
reflecting a light beam off of the mirror element;
energizing the coil so that the core transitions from the natural position toward the energized position and
de-energizing the coil so that the core transitions back to the natural position.

28. A switching method:
providing a switching device comprising:
a housing having a body defining a cavity with a centered cavity longitudinal axis and a first cavity lateral axis, wherein the first cavity lateral axis intersects the housing body at opposite housing magnetic poles;
a core having a body that is smaller than the cavity located in the cavity such that a centered core longitudinal axis aligns with the centered cavity longitudinal axis with a gap between the core body and housing body, the core body having opposite core magnetic poles on a core lateral axis that are magnetically aligned with the housing magnetic poles when in a natural magnetic state;
an armature connected with the housing such that opposite armature magnetic poles are not aligned with the first cavity lateral axis, wherein the core magnetic poles are magnetically aligned with the armature magnetic poles when in an energized magnetic state; and
a coil operably coupled with the armature so as to generates a magnetic field in the armature that transitions the core from a natural position of the natural magnetic state to an energized position of the energized magnetic state when the coil is energized, wherein the core returns to the natural position when the coil is not energized; and
switching the switching device between the natural magnetic state and energized magnetic state.

29. The method of claim 28 comprising:
energizing the coil; and
transitioning the core between the natural position and energized position.

30. The method of claim 28 comprising:
energizing the coil so that the core transitions from the natural position toward the energized position and
de-energizing the coil so that the core transitions back to the natural position.

31. The method of claim 28 comprising:
reflecting a light beam off of a mirror element that is coupled with the core; and
switching the switching device between the natural magnetic state and energized magnetic state.

32. The method of claim 28 comprising:
reflecting a light beam off of a mirror element that is coupled with the core;
energizing the coil; and
transitioning the core between the natural position and energized position.

33. The method of claim 28 comprising:
reflecting a light beam off of a mirror element that is coupled with the core;
energizing the coil so that the core transitions from the natural position toward the energized position and
de-energizing the coil so that the core transitions back to the natural position.

34. The method of claim 28 comprising:
reflecting a light beam off of a mirror element that is coupled with the core; and
scanning an article with the light beam.

35. The method of claim 34, wherein the light beam is a laser beam.

* * * * *